US011498340B2

(12) United States Patent
Takahashi et al.

(10) Patent No.: US 11,498,340 B2
(45) Date of Patent: Nov. 15, 2022

(54) INKJET PRINTING DEVICE, INKJET PRINTING METHOD, AND METHOD FOR CONTROLLING GLOSSINESS OF PRINTED IMAGE

(71) Applicant: RICOH COMPANY, LTD., Tokyo (JP)

(72) Inventors: Hiroaki Takahashi, Kanagawa (JP); Mio Akima, Tokyo (JP); Kiminori Masuda, Tokyo (JP); Hiroki Nakane, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 117 days.

(21) Appl. No.: 16/973,236

(22) PCT Filed: May 23, 2019

(86) PCT No.: PCT/JP2019/020529

§ 371 (c)(1),
(2) Date: Dec. 8, 2020

(87) PCT Pub. No.: WO2019/239843

PCT Pub. Date: Dec. 19, 2019

(65) Prior Publication Data

US 2021/0237468 A1 Aug. 5, 2021

(30) Foreign Application Priority Data

Jun. 15, 2018 (JP) ..... JP2018-114306
Mar. 4, 2019 (JP) ..... JP2019-038320

(51) Int. Cl.
*B41J 2/15* (2006.01)
*B41J 2/21* (2006.01)
(Continued)

(52) U.S. Cl.
CPC ..... *B41J 2/2114* (2013.01); *B41J 11/002* (2013.01); *B41M 7/009* (2013.01)

(58) Field of Classification Search
None
See application file for complete search history.

(56) References Cited

U.S. PATENT DOCUMENTS 5,852,462 A * 12/1998 Lloyd ..... G03G 15/2003 347/156
6,751,424 B2 6/2004 Komatsu et al.
(Continued)

FOREIGN PATENT DOCUMENTS

CN 103241007 A 8/2013
CN 103625134 A 3/2014
(Continued)

OTHER PUBLICATIONS

International Search Report dated Sep. 10, 2019 for counterpart International Patent Application No. PCT/JP2019/020529 filed May 23, 2019.
(Continued)

*Primary Examiner* — Erica S Lin
*Assistant Examiner* — Tracey M McMillion
(74) *Attorney, Agent, or Firm* — Grüneberg and Myers, PLLC

(57) ABSTRACT

Provided is an inkjet printing device including an ink storage unit configured to store an ink, an ejection head configured to eject the ink to form a print layer, and a heating unit configured to heat a material to be printed, wherein the ink is an aqueous clear ink including a resin and water, the inkjet printing device has a low gloss printing mode that is a printing mode for imparting low gloss, and a high gloss printing mode that is a printing mode for imparting high gloss, and the heating unit is configured to heat to satisfy the following formula $T_{matte}>T_{gloss}$, where $T_{matte}$ (degrees Celsius) is a temperature of a low gloss printing region of the material to be printed where the low gloss printing region is printed with the low gloss printing mode when the aqueous
(Continued)

clear ink is deposited on the material to be printed, and $T_{gloss}$ (degrees Celsius) is a temperature of a high gloss printing region of the material to be printed where the high gloss printing region is printed with the high gloss printing mode when the aqueous clear ink is deposited on the material to be printed.

13 Claims, 1 Drawing Sheet

(51) Int. Cl.
*B41J 11/00* (2006.01)
*B41M 7/00* (2006.01)

(56) References Cited

U.S. PATENT DOCUMENTS

| | | | | |
|---|---|---|---|---|
| 2005/0156964 | A1 | 7/2005 | Hoshino | |
| 2009/0225143 | A1 | 9/2009 | Fukui | |
| 2011/0194869 | A1 | 8/2011 | Yoshinaga et al. | |
| 2012/0281049 | A1 | 11/2012 | Kachi | |
| 2013/0201269 | A1 | 8/2013 | Hozumi | |
| 2014/0055511 | A1* | 2/2014 | Smith | B41J 3/60 347/9 |
| 2014/0340456 | A1 | 11/2014 | Waschnig | |
| 2014/0375720 | A1* | 12/2014 | Sato | B41J 11/00242 347/17 |
| 2016/0096379 | A1 | 4/2016 | Wetjens et al. | |
| 2016/0303870 | A1* | 10/2016 | Moriguchi | B41J 2/0057 |
| 2017/0057245 | A1 | 3/2017 | Morita et al. | |
| 2018/0001669 | A1 | 1/2018 | Furukawa et al. | |
| 2018/0030292 | A1* | 2/2018 | Gotou | C09D 11/037 |
| 2018/0030300 | A1 | 2/2018 | Ohta | |

FOREIGN PATENT DOCUMENTS

| | | | | |
|---|---|---|---|---|
| CN | 104023987 | A | | 9/2014 |
| JP | 2004-261976 | A | | 9/2004 |
| JP | 2004-314350 | A | | 11/2004 |
| JP | 2007256694 | A | * | 10/2007 |
| JP | 2009-51095 | A | | 3/2009 |
| JP | 2009-208348 | A | | 9/2009 |
| JP | 2010-173287 | A | | 8/2010 |
| JP | 2011-83917 | A | | 4/2011 |
| JP | 5421323 | B2 | | 11/2013 |
| JP | 5445188 | B2 | | 1/2014 |
| JP | 2015-3397 | A | | 1/2015 |

OTHER PUBLICATIONS

Written Opinion dated Sep. 10, 2019 for counterpart International Patent Application No. PCT/JP2019/020529 filed May 23, 2019.
PCT Collaborative Search and Examination Pilot Peer Contribution uploaded Jul. 27, 2019 by the USPTO which is a peer ISA for counterpart International Patent Application No. PCT/JP2019/020529 filed May 23, 2019.
PCT Collaborative Search and Examination Pilot Peer Contribution uploaded Aug. 16, 2019 by the EPO which is a peer ISA for counterpart International Patent Application No. PCT/JP2019/020529 filed May 23, 2019.
PCT Collaborative Search and Examination Pilot Peer Contribution uploaded Aug. 12, 2019 by the CNIPA which is a peer ISA for counterpart International Patent Application No. PCT/JP2019/020529 filed May 23, 2019.
PCT Collaborative Search and Examination Pilot Peer Contribution uploaded Aug. 12, 2019 by the KIPO which is a peer ISA for counterpart International Patent Application No. PCT/JP2019/020529 filed May 23, 2019.
Extended European Search Report dated Jun. 18, 2021 in European Application No. 19819062.1.

* cited by examiner

INKJET PRINTING DEVICE, INKJET PRINTING METHOD, AND METHOD FOR CONTROLLING GLOSSINESS OF PRINTED IMAGE

TECHNICAL FIELD

The present disclosure relates to an inkjet printing device, an inkjet printing method, and a method for controlling glossiness of a printed image.

BACKGROUND ART

In order to improve durability (e.g., lightfastness, water resistance, and abrasion resistance) of wrapping materials for industrial use (e.g., advertising and billboard), food, and drinks, for example, non-permeable recording media, such as plastic films, have been used. Various inks used for such non-permeable recording media have been developed.

As such an ink, for example, a solvent-based ink using an organic solvent as a solvent, or an ultraviolet ray-curable ink including a polymerizable monomer as a main component has been widely used. However, there is a concern associated with the solvent-based ink that the organic solvent evaporated from the ink may adversely affects the environment. The ultraviolet ray curable ink may have the limited choices in the polymerizable monomer for use in view of safety.

Accordingly, proposed is an ink set including aqueous inks that give low environmental loads and can be directly printed on a non-permeable print medium.

Meanwhile, inkjet printing devices having a function of controlling gloss have been developed.

For example, proposed is a liquid jetting device including a liquid jet head capable of jetting an ink including thermoplastic resin particles towards a landing target and a heating unit configured to heat the ink droplets landed on the landing target, where the heating unit configured to control a degree of film formation of surfaces of the ink droplets by heating at a film formation controlling temperature corresponding to the minimum film formation temperature at which the surfaces of the ink droplets start to form a film (see, for example, PTL 1).

CITATION LIST

Patent Literature

PTL 1: Japanese Unexamined Patent Application Publication No. 2015-3397

SUMMARY OF INVENTION

Technical Problem

The present disclosure has an object to provide an inkjet printing device that can correspond to glossiness control of both matte gloss and gloss.

Solution to Problem

According to one aspect of the present disclosure, an inkjet printing device including an ink storage unit configured to store an ink, an ejection head configured to eject the ink to form a print layer, and a heating unit configured to heat a material to be printed. The ink is an aqueous clear ink including a resin and water. The inkjet printing device has a matte gloss printing mode that is a printing mode for imparting matte gloss, and a gloss printing mode that is a printing mode for imparting gloss. The heating unit is configured to heat to satisfy the following formula $T_{matte}>T_{gloss}$, where $T_{matte}$ degrees Celsius) is a temperature of a matte printing region of the material to be printed where the matte printing region is printed with the matte gloss printing mode when the aqueous clear ink is deposited on the material to be printed, and $T_{gloss}$ (degrees Celsius) is a temperature of a gloss printing region of the material to be printed where the gloss printing region is printed with the gloss printing mode when the aqueous clear ink is deposited on the material to be printed.

Advantageous Effects of Invention

The present invention can provide an inkjet printing device that can correspond to glossiness control of both matte gloss and gloss.

Figure 1:
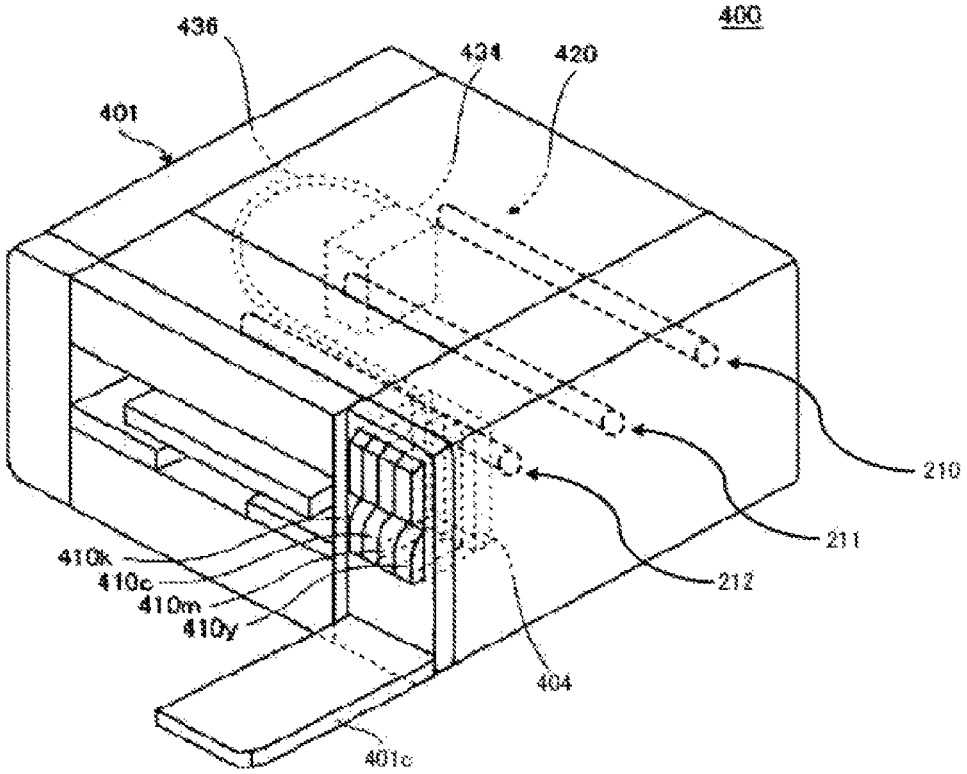
FIG. 1 is a view illustrating an example of an image forming apparatus for carrying out an image forming method of the present disclosure.

DESCRIPTION OF EMBODIMENTS (Inkjet Printing Device and Inkjet Printing Method)

An inkjet printing device of the present disclosure includes an ink storage unit configured to store an ink, an ejection head configured to eject the ink to form a print layer, and a heating unit configured to heat a material to be printed. The ink is an aqueous clear ink including a resin and water. The inkjet printing device has a matte gloss printing mode that is a printing mode for imparting matte gloss, and a gloss printing mode that is a printing mode for imparting gloss. The heating unit is configured to heat to satisfy the following formula $T_{matte}>T_{gloss}$, where $T_{matte}$ degrees Celsius) is a temperature of a matte printing region of the material to be printed where the matte printing region is printed with the matte gloss printing mode when the aqueous clear ink is deposited on the material to be printed, and $T_{gloss}$ (degrees Celsius) is a temperature of a gloss printing region of the material to be printed where the gloss printing region is printed with the gloss printing mode when the aqueous clear ink is deposited on the material to be printed. The inkjet printing device may further include other units according to the necessity.

An inkjet printing device of the present disclosure include an ink storage unit configured to store an ink, an ejection head configured to eject the ink to form a print layer, and a heating unit configured to heat a material to be printed. The ink is an aqueous clear ink including a resin and water. The inkjet printing device has a matte gloss printing mode that is a printing mode for imparting matte gloss, and a gloss printing mode that is a printing mode for imparting gloss. The heating unit is configured to heat to satisfy the following formula $HT_{matte}>HT_{gloss}$, where $HT_{matte}$ (degrees Celsius) is a temperature of the heating unit with the matte gloss printing mode and $HT_{gloss}$ (degrees Celsius) is a temperature of the heating unit with the gloss printing mode. The inkjet printing device may further include other units according to the necessity.

An inkjet printing method of the present disclosure includes ejecting an ink to a material to be printed to form a print layer, and heating the printed material to be printed. The ink is an aqueous clear ink including a resin and water. The inkjet printing method has a matte gloss printing mode that is a printing mode for imparting matte gloss, and a gloss printing mode that is a printing mode for imparting gloss. The heating unit is configured to heat to satisfy the following formula $T_{matte}>T_{gloss}$, where $T_{matte}$ (degrees Celsius) is a temperature of a matte printing region of the material to be printed where the matte printing region is printed with the matte gloss printing mode when the aqueous clear ink is deposited on the material to be printed, and $T_{gloss}$ (degrees Celsius) is a temperature of a gloss printing region of the material to be printed where the gloss printing region is printed with the gloss printing mode when the aqueous clear ink is deposited on the material to be printed. The inkjet printing method may further include other steps according to the necessity.

An inkjet printing method of the present disclosure includes ejecting an ink to a material to be printed to form a print layer, and heating the printed material to be printed with a heating unit. The ink is an aqueous clear ink including a resin and water. The inkjet printing method has a matte gloss printing mode that is a printing mode for imparting matte gloss, and a gloss printing mode that is a printing mode for imparting gloss. The heating unit is configured to heat to satisfy the following formula $HT_{matte}>HT_{gloss}$, where $HT_{matte}$ (degrees Celsius) is a temperature of the heating unit with the matte gloss printing mode and $HT_{gloss}$ (degrees Celsius) is a temperature of the heating unit with the gloss printing mode. The inkjet printing method may further include other steps according to the necessity.

In the art, a method for controlling gloss to give matte or gloss through control of irradiation light dose has been proposed in connection with an inkjet printing device using a clear ink (UV clear ink) that is cured by irradiation of ultraviolet rays. However, the UV clear ink has a problem that it has strong smell. The smell is remained on printed matter, and therefore use of the UV clear ink for printed matter for indoor use is not suitable. Accordingly, the inkjet printing device needs to be installed in an environment where the air therein can be discharged, and the installation are thereof is limited. Moreover, the UV clear ink has a problem that the UV clear ink requires an ultraviolet ray irradiation device and a scale there is large and cost thereof is high.

The inkjet printing device and the inkjet printing method of the present disclosure have been accomplished based on the following insights. In the technology disclosed in PTL 1, a color ink including a colorant is used, and glossiness is adjusted by controlling a degree of film formation of a surface of ink droplets, where the degree of the film formation is controlled by heating, by means of a heating unit, the ink droplets at a film formation controlling temperature corresponding to the minimum film formation temperature at which film formation of surfaces of the ink droplets start. However, the color ink including a colorant cannot obtain a sufficient difference in glossiness compared to a clear ink including no colorant, and gloss control of both matte and gloss cannot be achieved.

The inkjet printing device and the inkjet printing method of the present disclosure use an aqueous clear ink including a resin and water, and perform gloss control of both gloss and matte through control of a heating temperature. When matte gloss is imparted, printing is performed at a high temperature compared with a temperature during printing in the gloss printing mode. Since the temperature during printing is high, the aqueous clear ink including the resin suppresses wet spreading of dots and coalescence of adjacent dots, and dots having large height of a dot sphere (pile height) are formed. These dots form surface irregularities to impart matte gloss.

When gloss is imparted, on the other hand, printing is performed at a low temperature compared with the matte gloss printing mode. Since the temperature during printing is low, the aqueous clear ink including the resin accelerates wet spreading of dots and coalescence of adjacent dots to form a smooth surface. Therefore, gloss is imparted.

Accordingly, the inkjet printing device of the present disclosure can perform gloss control of both matte and gloss, because the inkjet printing device uses an aqueous clear ink including a resin and water, has a matte gloss printing mode that is a printing mode for imparting matte gloss and a gloss printing mode that is a printing mode for imparting gloss, and includes a heating unit configured to heat to satisfy the following formula $T_{matte}>T_{gloss}$ or the following formula $HT_{matte}>HT_{gloss}$, where $T_{matte}$ (degrees Celsius) is a temperature of a matte printing region of the material to be printed where the matte printing region is printed with the matte gloss printing mode when the aqueous clear ink is deposited on the material to be printed, and $T_{gloss}$ (degrees Celsius) is a temperature of a gloss printing region of the material to be printed where the gloss printing region is printed with the gloss printing mode when the aqueous clear ink is deposited on the material to be printed, and $HT_{matte}$ (degrees Celsius) is a temperature of the heating unit with the matte gloss printing mode and $HT_{gloss}$ (degrees Celsius) is a temperature of the heating unit with the gloss printing mode.

The heating unit of the inkjet printing device of the present disclosure preferably performs heating in a manner that a temperature of the material to be printed satisfies the following formula $T_{matte}>T_{gloss}$, preferably satisfies the following formula $T_{matte}-T_{gloss}\geq 10$ degrees Celsius, and more preferably satisfies the following formula $T_{matte}-T_{gloss}\geq 20$ degrees Celsius. Moreover, the temperature HT (degrees Celsius) of the heating unit satisfies the following formula $HT_{matte}>HT_{gloss}$, preferably satisfies the following formula $HT_{matte}>HT_{gloss}\geq 10$ degrees Celsius, and more preferably satisfies the following formula $HT_{matte}>HT_{gloss}\geq 20$ degrees Celsius, where $HT_{matte}$ (degrees Celsius) is a temperature of the heating unit with the matte gloss printing mode and $HT_{gloss}$ (degrees Celsius) is a temperature of the heating unit with the gloss printing mode.

As a result, the heating temperature is made high in the matte gloss printing mode to suppress wet spreading of dots and therefore dots of high pile heights are formed to form a surface having large irregularities. On the other hand, the heating temperature is made low in the gloss printing mode to accelerate wet spreading of dots to form a smooth surface owing to coalescence of the adjacent dots.

The temperature HT (degrees Celsius) of the heating unit is not particularly limited and may be appropriately selected depending on the intended purpose. For example, the set temperature of the heating unit can be used as the temperature HT.

The temperature $T_{matte}$ (degrees Celsius) of a matte gloss printing mode printed region of the material to be printed is preferably 50 degrees Celsius or higher, more preferably 50 degrees Celsius or higher but 80 degrees Celsius or lower.

The temperature $T_{gloss}$ (degrees Celsius) of a gloss printing mode printed region of the material to be printed is preferably 70 degrees Celsius or lower, and more preferably 60 degrees Celsius or lower.

The temperature $HT_{matte}$ (degrees Celsius) of the heating unit with the matte gloss printing mode is preferably 50 degrees Celsius or higher, more preferably 50 degrees Celsius or higher but 80 degrees Celsius or lower.

The temperature $HT_{gloss}$ (degrees Celsius) of the heating unit with the gloss printing mode is preferably 70 degrees Celsius or lower, more preferably 60 degrees Celsius or lower.

The large change in the glossiness can be realized in each printing mode using the aqueous clear ink by setting the temperature to the above-described temperature range. Examples of a method for measuring the printing region of the material to be printed include: a method where a thermocouple is disposed on a print medium as the material to be printed to directly measure a temperature of the print medium; a method where a temperature of a heater configured to heat a print medium is measured and the measured temperature is determined as a temperature of the print medium; and a method where a temperature surrounding a print medium is measured in a non-contact manner by means of a radiation thermometer etc., and the measured temperature is determined as a temperature of the print medium.

In the present disclosure, the following formula $D_{gloss}>D_{matte}$ is preferably satisfied, and the following formula $D_{gloss}-D_{matte}\geq 10\%$ is more preferably satisfied, where $D_{matte}$ is a printing rate of a matte print image to be printed in the matte gloss printing mode, and $D_{gloss}$, is a printing rate of a gloss print image to be printed in the gloss printing mode.

Since a smooth surface is more easily formed at a high printing rate, an image of a high printing rate is printed in the gloss printing mode. Since coalescence of adjacent dots occurs at a high printing rate and it is difficult to form surface irregularities, an image of a low printing rate is printed in the matte gloss printing mode.

Printing rate (%)=the number of printed dots of clear ink/(vertical resolution×horizontal resolution)×100

(in the formula above, "the number of printed dots of clear ink" is the number of dots formed per unit area by actually printing the clear ink, "vertical resolution" and "horizontal resolution" are each resolution per unit area, and in the case where the clear ink is printed to overlap to form dots on the same positions, "the number of printed dots of clear ink" represents the total number of dots formed per unit area by actually printing the clear ink.) Note that, the printing rate being 100% means the maximum ink weight of a single color relative to a pixel.

<Ink Storage Unit>

The ink storage unit is configured to store an ink.

The ink storage unit is not particularly limited as long as the ink storage unit is a member capable of storing an ink therein. Examples of the ink storage unit include an ink storage container and an ink tank.

The ink storage container includes the ink stored in a container, and may further include other members appropriately selected depending on the necessity.

The container is not particularly limited and a shape, structure, size, and material thereof are appropriately selected depending on the intended purpose. Examples of the container include a container including at least an ink bag formed of an aluminium laminate film, and a resin film.

Examples of the ink tank include a main tank and a sub tank.

<Ejection Head>

The ejection head is configured to eject an ink to form a print layer.

The ejection head includes a nozzle plate, a pressurizing chamber, and a stimulus generating unit.

—Nozzle Plate—

The nozzle plate includes a nozzle substrate, and an ink repellent film disposed on the nozzle substrate.

—Pressurizing Chamber—

The pressurizing chamber is disposed to correspond to each of a plurality of nozzle holes disposed in the nozzle plate. The pressurizing chambers are a plurality of individual flow channel connected to each of the nozzle holes. The pressurizing chamber may be also referred as an ink flow channel, a pressurizing liquid chamber, a pressure chamber, an ejection chamber, or a liquid chamber.

—Stimulus Generating Unit—

The stimulus generating unit is a unit configured to generate stimulus to be applied to an ink.

The stimulus generated by the stimulus generating unit is not particularly limited and may be appropriately selected depending on the intended purpose. Examples of the stimulus include heat (temperature), pressure, vibration, and light. The above-listed examples may be used alone or in combination. Among the above-listed examples, heat and pressure are preferable.

Examples of the stimulus generating unit include a heating device, a pressure device, a piezoelectric element, a vibration generating device, an ultrasonic oscillator, and a light. Specific examples of the stimulus generating unit include: piezoelectric actuators, such as piezoelectric elements; thermal actuators each utilizing a phase change caused by film boiling of an ink using an electrothermal energy conversion element, such as a heat resistor; shape-memory alloy actuators each utilizing a metal phase change due to a temperature change; and electrostatic actuators each utilizing an electrostatic force.

In the case where the stimulus is "heat," thermal energy corresponding to a printing signal is applied to an ink inside the ejection head, for example, by means of a thermal head. Bubbles are formed in the ink by the thermal energy, and the ink is ejected as droplets from the nozzle holes of the nozzle plate by the pressure of the bubbles.

In the case where the stimulus is "pressure," the piezoelectric element is bent by applying voltage to the piezoelectric element bonded to a position, so called, the pressure chamber in an ink flow path of the ejection head. As a result, a volume of the pressure chamber is contracted to eject the ink, as droplets, from the nozzle holes of the ejection head.

Among the above-described examples, a piezo system where an ink is discharged by applying voltage to a piezoelectric element is preferable.

<Heating Unit>

The heating unit (210, 211, 212) is configured to heat a material to be printed.

The heating unit includes a unit configured to heat and dry a printed surface and back surface of a print medium serving as a material to be printed. Examples of the heating unit include an infrared ray heater, a hot air heater, and a heat roller. The above-listed examples may be used alone or in combination.

A method for drying the print medium serving as the material to be printed is not particularly limited and may be appropriately selected depending on the intended purpose. Examples of the method include: a method where the print medium to which the ink has been deposited is brought into contact with a heated fluid, such as hot air as a drying unit; a method where the print medium to which the ink has been deposited is brought into contact with a heating member to heat through heat transfer; and a method where the print medium to which the ink has been deposited is heated by applying energy rays, such as inferred rays and far infrared rays.

The heating may be performed before printing (210), during printing (211), after printing (212), or any combination thereof.

By heating before or during printing, printing can be performed on a heated medium. By heating after printing, printed matter can be dried.

The heating duration is not particularly limited and may be appropriately selected depending on the intended purpose, as long as a surface temperature of the print medium can be controlled to a desired temperature.

The heating duration can be controlled by controlling transferring speed of the print medium serving as the material to be printed.

<Ink>

As the ink, an aqueous clear ink is used.

The clear ink means a colorless clear ink substantially including no colorant.

The aqueous clear ink means a clear ink including water as a solvent, and the aqueous clear ink may further include an organic solvent according to the necessity.

The aqueous clear ink includes water and a resin, preferably further includes a surfactant, and may further include other ingredients according to the necessity.

<<Water>>

The water is not particularly limited and may be appropriately selected depending on the intended purpose. Examples of the water include pure water, such as ion-exchanged water, ultrafiltration water, reverse osmosis-filtered water, distilled water, and ultrapure water. The above-listed examples may be used alone or in combination. An amount of the water is preferably 15% by mass or greater but 60% by mass or less relative to a total amount of the aqueous clear ink. When the amount thereof is 15% by mass or greater, an excessive increase in viscosity can be prevented and ejection stability can be improved. When the amount thereof is 60% by mass or less, wettability to a non-permeable print medium is excellent and image quality can be improved.

<<Resin>>

The resin is not particularly limited and may be appropriately selected depending on the intended purpose. Examples of the resin include a polyurethane resin, a polyester resin, an acrylic resin, a vinyl acetate-based resin, a styrene resin, a butadiene resin, a styrene-butadiene resin, a vinyl chloride resin, an acryl-styrene resin, and an acryl-silicone resin.

When an ink is produced, resin particles formed of any of the above-listed resins are preferably added. The resin particles may be added to the ink in a state of a resin emulsion in which the resin particles are dispersed using water as a dispersion medium. As the resin particles, resin particles appropriately synthesized may be used, or a commercial product may be used. The above-listed examples may be used alone or in combination. Among the above-listed examples, a polyurethane resin is preferable. When an ink film is formed using a clear ink, toughness of the coating film is increased by adding the polyurethane resin. The addition of the polyurethane resin is preferable because partial peeling of the coating film due to breakage inside the coating film, or a change of a color of the friction area due to a change in a surface state of the coating film.

—Polyurethane Resin—

Examples of the polyurethane resin include a polyether-based polyurethane resin, a polycarbonate-based polyurethane resin, and a polyester-based polyurethane resin.

The polyurethane resin is not particularly limited and may be appropriately selected depending on the intended purpose. Examples of the polyurethane resin obtained through a reaction between polyol and polyisocyanate.

—Polyol—

Examples of the polyol include polyether polyol, polycarbonate polyol, and polyester polyol. The above-listed examples may be used alone or in combination.

—Polyether Polyol—

Examples of the polyether polyol include polyether polyol obtained by addition polymerization of alkylene oxide using at least one compound including 2 or more active hydrogen atoms as a starting material.

Examples of the compound including 2 or more active hydrogen atoms include ethylene glycol, diethylene glycol, triethylene glycol, propylene glycol, trimethylene glycol, 1,3-butanediol, 1,4-butanediol, 1,6-hexanediol, glycerin, trimethylol ethane, and trimethylol propane. The above-listed examples may be used alone or in combination.

Examples of the alkylene oxide include ethylene oxide, propylene oxide, butylene oxide, styrene oxide, epichlorohydrin, and tetrahydrofuran. The above-listed examples may be used alone or in combination.

The polyether polyol is not particularly limited and may be appropriately selected depending on the intended purpose. In view of formation of a binder for an ink capable of imparting extremely excellent abrasion resistance, polyoxytetramethylene glycol and polyoxypropylene glycol are preferable. The above-listed examples may be used alone or in combination.

—Polycarbonate Polyol—

Moreover, examples of the polycarbonate polyol used for production of the polyurethane resin include polycarbonate polyol obtained through a reaction between carbonic acid ester and polyol, and polycarbonate polyol obtained through a reaction between phosgene and bisphenol A. The above-listed examples may be used alone or in combination.

Examples of the carbonic acid ester include methyl carbonate, dimethyl carbonate, ethyl carbonate, diethyl carbonate, cyclocarbonate, and diphenyl carbonate. The above-listed examples may be used alone or in combination.

Examples of the polyol include: dihydroxy compounds of relatively low molecular weight, such as ethylene glycol, diethylene glycol, triethylene glycol, 1,2-propylene glycol, 1,3-propylene glycol, dipropylene glycol, 1,4-butanediol, 1,3-butanediol, 1,2-butanediol, 2,3-butanediol, 1,5-pentanediol, 1,5-hexanediol, 2,5-hexanediol, 1,6-hexanediol, 1,7-heptanediol, 1,8-octanediol, 1,9-nonanediol, 1,10-decanediol, 1,11-undecanediol, 1,12-dodecanediol, 1,4-cyclohexanediol, 1,4-cyclohexanedimethanol, hydroquinone, resorcinol, bisphenol-A, bisphenol-F, and 4,4'-biphenol; polyether polyol, such as polyethylene glycol, polypropylene glycol, and polyoxytetramethylene glycol; and polyester polyol, such as polyhexamethylene adipate, polyhexamethylene succinate, and polycaprolactone. The above-listed examples may be used alone or in combination.

—Polyester Polyol—

Examples of the polyester polyol include polyester polyol obtained through an esterification reaction between low molecular weight polyol and polycarboxylic acid, polyester obtained through a ring-opening polymerization reaction of a cyclic ester compound, such as ε-caprolactone, and copolymer polyester thereof. The above-listed examples may be used alone or in combination.

Examples of the low molecular weight polyol include ethylene glycol, and propylene glycol. The above-listed examples may be used alone or in combination.

Examples of the polycarboxylic acid include succinic acid, adipic acid, sebacic acid, dodecane dicarboxylic acid, terephthalic acid, isophthalic acid, phthalic acid, anhydrides thereof, and ester-formable derivatives thereof. The above-listed examples may be used alone or in combination.

—Polyisocyanate—

Examples of the polyisocyanate include: aromatic diisocyanate, such as phenylene diisocyanate, tolylene diisocyanate, diphenylmethane diisocyanate, and naphthalene diisocyanate; and aliphatic or alicyclic diisocyanate, such as hexamethylene diisocyanate, lysine diisocyanate, cyclohexane diisocyanate, isophorone diisocyanate, dicyclohexylmethane diisocyanate, xylene diisocyanate, tetramethylxylene diisocyanate, and 2,2,4-trimethylhexamethylene diisocyanate. The above-listed examples may be used alone or in combination. Among the above-listed examples, alicyclic diisocyanate is preferable in view of weather resistance.

Moreover, intended coating film strength and abrasion resistance can be easily obtained by using at least one kind of alicyclic diisocyanate.

Examples of the alicyclic diisocyanate include isophorone diisocyanate, and dicyclohexylmethane diisocyanate.

An amount of the alicyclic diisocyanate is preferably 60% by mass or greater relative to a total amount of the isocyanate compound.

(Production Method of Polyurethane Resin)

The polyurethane resin is not particularly limited and can be obtained by any of production methods typically used in the art. Examples of the production method thereof include the following method.

First, the polyol and the polyisocyanate are allowed to react at an equivalent ratio with which isocyanate groups are excessive without a solvent or in the presence of an organic solvent, to thereby produce a urethane prepolymer including an isocyanate terminal.

Subsequently, anionic groups in the urethane prepolymer including isocyanate terminal are neutralized by a neutralizer. Thereafter, the prepolymer is allowed to react with a chain extender, followed by optionally removing the organic solvent, to thereby obtain a polyurethane resin.

Examples of the organic solvent that can be used for the production of the polyurethane resin include: ketones, such as acetone, and methyl ethyl ketone; ethers, such as tetrahydrofuran and dioxane; acetic acid esters, such as ethyl acetate, and butyl acetate; nitriles, such as acetonitrile; and amides, such as dimethylformamide, N-methylpyrrolidone, and N-ethylpyrrolidone. The above-listed examples may be used alone or in combination.

Examples of the chain extender include polyamine and other active hydrogen group-containing compounds.

Examples of the polyamine include: diamines, such as ethylenediamine, 1,2-propanediamine, 1,6-hexamethylenediamine, puperazine, 2,5-dimethylpuperazine, isophoronediamine, 4,4'-dicyclohexylmethanediamine, and 1,4-cyclohexanediamine; polyamine, such as diethylenetriamine, dipropylenetriamine, and triethylenetetramine; hydrazines, such as hydrazine, N,N'-dimethylhydrazine, and 1,6-hexamethylenebishydrazine; and succinic dihydrazide, adipic dihydrazide, glutaric dihydrazide, sebacic dihydrazide, and isophthalic dihydrazide. The above-listed examples may be used alone or in combination.

Examples of the other active hydrogen group-containing compound include: glycols, such as ethylene glycol, diethylene glycol, triethylene glycol, propylene glycol, 1,3-propanediol, 1,3-butanediol, 1,4-butanediol, hexamethylene glycol, saccharose, methylene glycol, glycerin, and sorbitol; phenols, such as bisphenol A, 4,4'-dihydroxydiphenyl, 4,4'-dihydroxydiphenyl ether, 4,4'-dihydroxydiphenylsulfone, hydrogenated bisphenol A, and hydroquinone; and water. The above-listed examples may be used alone or in combination as long as storage stability of a resultant ink is not impaired.

The polyurethane resin is preferably a polycarbonate-based polyurethane resin in view of water resistance owing to high aggregation force of carbonate groups, heat resistance, abrasion resistance, weather resistance, and abrasion resistance of an image. When the polycarbonate-based polyurethane resin is used, an ink suitable for printed matter used in a severe environment, such as outdoor use can be obtained.

As the polyurethane resin, a commercial product may be used. Examples of the commercial product thereof include UCOAT UX-485 (polycarbonate-based polyurethane resin), UCOAT UWS-145 (polyester-based polyurethane resin), PERMARIN UA-368T (polycarbonate-based polyurethane resin), and PERMARIN UA-200 (polyether-based polyurethane resin) (all available from Sanyo Chemical Industries, Ltd.). The above-listed examples may be used alone or in combination.

An amount of the resin included in the clear ink is preferably 8% by mass or greater, and more preferably 8% by mass or greater but 25% by mass or less. When the amount of the resin is 8% by mass or greater, matte gloss and gloss can be controlled with a small amount of the clear ink. When the amount of the resin is greater than 25% by mass, ejection stability of the ink may be degraded.

Matte gloss is achieved by forming individual dots each having a large height of a dot sphere (pile height), and imparting irregularities to a surface.

When an amount of the resin in the clear ink is large, dots having high pile heights are easily formed and matte glossiness is easily imparted. Therefore, use of a large amount of the resin in the clear ink is preferable.

On the other hand, gloss is achieved by filling the irregularities of a surface with a clear ink to form a smooth surface to impart smoothness. In order to fill the irregularities of the surface with the clear ink, use of a large amount of the resin in the clear ink is preferable because the irregularities of the surface can be filled with a small amount of the clear ink and gloss is easily imparted.

In the manner as described above, a matte gloss printing mode that is an equivalent of the low gloss printing mode and a gloss printing mode that is an equivalent of the high gloss printing mode are set.

<Surfactant>

The clear ink preferably includes a surfactant.

When the surfactant is added to the ink, the surface tension of the ink is reduced to accelerate permeation of the ink to a print medium after the ink droplets are landed on the print medium, such as paper. Therefore, feathering or color bleeding can be reduced.

The surfactant is classified into a nonionic surfactant, an anionic surfactant, and amphoteric surfactant depending on a polarity of a hydrophilic group of the surfactant.

Moreover, the surfactant is classified into a fluorine-based surfactant, a silicone-based surfactant, and an acetylene-based surfactant depending on a structure of a hydrophobic group of the surfactant.

In the present disclosure, a fluorine-based surfactant is mainly used, but a silicone-based surfactant or an acetylene-based surfactant may be used in combination.

An amount of the surfactant is preferably 2% by mass or less, more preferably 0.05% by mass or greater but 2% by mass or less, and more preferably 0.1% by mass or greater but 2% by mass or less. When the amount of the surfactant is 2% by mass or less, significant reduction in glossiness can be obtained with the matte gloss printing mode.

As a surfactant, any of silicone-based surfactants, fluorosurfactants, amphoteric surfactants, nonionic surfactants, anionic surfactants, etc. can be used.

The silicone-based surfactant has no specific limit and can be suitably selected to suit to a particular application. Of these, preferred are silicone-based surfactants which are not decomposed even in a high pH environment. Specific examples thereof include, but are not limited to, side-chain-modified polydimethylsiloxane, both end-modified polydimethylsiloxane, one-end-modified polydimethylsiloxane, and sidechain-both-end-modified polydimethylsiloxane. A silicone-based surfactant having a polyoxyethylene group or a polyoxyethylene polyoxypropylene group is particularly preferable because such an agent demonstrates good characteristics as an aqueous surfactant. It is possible to use a polyether-modified silicone-based surfactant as the silicone-based surfactant. A specific example thereof is a compound in which a polyalkylene oxide structure is introduced into the side chain of the Si site of dimethyl siloxane.

Specific examples of the fluoro surfactants include, but are not limited to, perfluoroalkyl sulfonic acid compounds, perfluoroalkyl carboxylic acid compounds, perfluoroalkyl phosphoric acid ester compounds, adducts of perfluoroalkyl ethylene oxide, and polyoxyalkylene ether polymer compounds having a perfluoroalkyl ether group in its side chain. These are particularly preferable because they do not foam easily. Specific examples of the perfluoroalkyl sulfonic acid compounds include, but are not limited to, perfluoroalkyl sulfonic acid and salts of perfluoroalkyl sulfonic acid. Specific examples of the perfluoroalkyl carboxylic acid compounds include, but are not limited to, perfluoroalkyl carboxylic acid and salts of perfluoroalkyl carboxylic acids. Specific examples of the polyoxyalkylene ether polymer compounds having a perfluoroalkyl ether group in its side chain include, but are not limited to, sulfuric acid ester salts of polyoxyalkylene ether polymer having a perfluoroalkyl ether group in its side chain and salts of polyoxyalkylene ether polymers having a perfluoroalkyl ether group in its side chain. Counter ions of salts in these fluorine-based surfactants are, for example, Li, Na, K, $NH_4$, $NH_3CH_2CH_2OH$, $NH_2(CH_2CH_2OH)_2$, and $NH(CH_2CH_2OH)_3$. Specific examples of the amphoteric surfactants include, but are not limited to, lauryl aminopropionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ether, polyoxyethylene alkyl esters, polyoxyethylene alkyl amine, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides, etc.

Specific examples of the anionic surfactants, but are not limited to, polyoxyethylene alkyl ether acetates, dodecyl benzene sulfonates, laurates, and polyoxyethylene alkyl ether sulfates.

These can be used alone or in combination.

The silicone-based surfactants have not particular limit. Specific examples thereof include, but are not limited to, side-chain-modified polydimethyl siloxane, both end-modified polydimethylsiloxane, one-end-modified polydimethylsiloxane, and sidechain-both-end-modified polydimethylsiloxane. In particular, a polyether-modified silicone-based surfactant having a polyoxyethylene group or a polyoxyethylene polyoxypropylene group is particularly preferable because such a surfactant demonstrates good characteristics as an aqueous surfactant.

Any suitable synthesized surfactant and any product thereof available on the market is suitable. Products available on the market are obtained from BYK Japan KK, Shin-Etsu Silicone Co., Ltd., Dow Corning Toray Co., Ltd., NIHON EMULSION Co., Ltd., Kyoeisha Chemical Co., Ltd., etc.

The polyether-modified silicone-containing surfactant has no particular limit. For example, a compound in which the polyalkylene oxide structure represented by the following Chemical Structure S-1 is introduced into the side chain of the Si site of dimethyl polysiloxane.

(Chemical Structure (S-1))

[Chem.1]

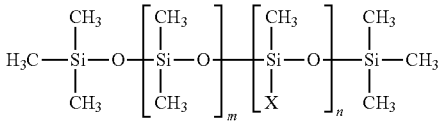

$X = -R(C_2H_4O)_a(C_3H_8O)_b R'$ (In the Chemical structure S-1, "m", "n", "a", and "b" each, respectively represent integers, R represents an alkylene group, and R' represents an alkyl group.)

Specific examples of polyether-modified silicone-based surfactants include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.), BYK-33 and BYK387 (both manufactured by BYK Japan KK.), and TSF4440, TSF4452, and TSF4453 (all manufactured by Momentive Performance Materials Inc.).

A fluorosurfactant in which the number of carbon atoms replaced with fluorine atoms is from 2 to 16 is preferable and, 4 to 16, more preferable.

Specific examples of the fluorosurfactants include, but are not limited to, perfluoroalkyl phosphoric acid ester compounds, adducts of perfluoroalkyl ethylene oxide, and polyoxyalkylene ether polymer compounds having a perfluoroalkyl ether group in its side chain. Of these, polyoxyalkylene ether polymer compounds having a perfluoroalkyl ether group in its side chain are preferable because they do not foam easily and the fluorosurfactant represented by the following Chemical formula F-1 or Chemical formula F-2 is more preferable.

(Chemical Formula (F-1))

$$CF_3CF_2(CF_2CF_2)_m—CH_2CH_2O(CH_2CH_2O)_nH$$ [Chem. 2]

In the Chemical formula F-1, "m" is preferably 0 or an integer of from 1 to 10 and "n" is preferably 0 or an integer of from 1 to 40, in order to impart water solubility.

(Chemical Formula (F-2))

$$C_nF_{2n+1}CH_2CH(OH)CH_2—O—(CH_2CH_2O)_a—Y$$

In the Chemical formula F-2, Y represents H, $CmF_{2m+1}$, where "m" is an integer of from 1 to 6, $CH_2CH(OH)CH_2—CmF_{2m+1}$, where "m" is an integer of from 4 to 6, or $CpH_{2p+1}$, where "p" represents an integer of from 1 to 19. "n" is an integer of from 1 to 6. "a" is an integer of from 4 to 14.

Products available on the market may be used as the fluorosurfactant.

Specific examples of the products available on the market include, but are not limited to, SURFLON S-111, SURFLON S-112, SURFLON S-113, SURFLON S-121, SURFLON S-131, SURFLON S-132, SURFLON S-141, and SURFLON S-145 (all manufactured by ASAHI GLASS CO., LTD.); FLUORAD FC-93, FC-95, FC-98, FC129, FC-135, FC-170C, FC-430, and FC-431 (all manufactured by SUMITOMO 3M); MEGAFACE F-470, F-1405, and F-474 (all manufactured by DIC CORPORATION); Zonyl™ TBS, FSP, FSA, FSN-100, FSN, FSO-100, FSO, FS-300, UR, CAPSTONE™ FS-30, FS-31, FS-3100, FS-34, and FS-35 (all manufactured by The Chemours Company); FT-110, FT-250, FT-251, FT-4005, FT-150, and FT-400SW (all manufactured by NEOS COMPANY LIMITED); POLYFOX PF-136A, PF-156A, PF-151N, PF-154, and PF-159 (manufactured by OMNOVA SOLUTIONS INC.); and UNIDYNE DSN-403N (manufactured by DAIKIN INDUSTRIES). Of these, FS-3100, FS-34, and FS-300 (all manufactured by The Chemours Company), FT-110, FT-250, FT-251, FT-4005, FT-150, and FT-400SW (all manufactured by NEOS COMPANY LIMITED), PolyFox PF-151N (manufactured by OMNOVA SOLUTION INC.), and UNIFYNE DSN-403N (manufactured by DAIKIN INDUSTRIES) are particularly preferable in terms of good printing quality, coloring in particular, and improvement on permeation, wettability, and uniform drying property to paper.

<<Organic Solvent>>

The clear ink may include an organic solvent. The organic solvent is not particularly limited and may be appropriately selected depending on the intended purpose. Examples of the organic solvent include a water-soluble organic solvent. The term "water-soluble" means, for example, that the organic solvent in the amount of 5 g or greater is dissolved in 100 g of water at 25 degrees Celsius.

Specific examples of the water-soluble organic solvents include, but are not limited to, polyvalent alcohols, such as ethylene glycol, diethylene glycol, 1,2-propanediol, 1,3-propanediol, 1,2-butanediol, 1,3-butanediol, 2,3-butanediol, 3-methyl-1,3-butanediol, 3-methoxy-3-methylbutanol, triethylene glycol, polyethylene glycol, polypropylene glycol, 1,5-pentanediol, 2-methyl-2,4-pentanediol, 1,6-hexanediol, glycerin, 1,2,6-hexanetriol, 2-ethyl-1,3-hexanediol, ethyl1, 2,4-butanetriol, 1,2,3-butanetriol, and petriol; polyvalent alcohol alkylethers, such as ethylene glycol monoethylether, ethylene glycol monobutylether, diethylene glycol monomethylether, diethylene glycol monoethylether, diethylene glycol monobutylether, tetraethylene glycol monomethylether, propylene glycol monoethylether, and dipropylene glycol monomethylether; polyvalent alcohol arylethers, such as ethylene glycol monophenylether, and ethylene glycol monobenzylether; nitrogen-containing heterocyclic compounds, such as 2-pyrrolidone, Nmethyl-2-pyrrolidone, N-hydroxyethyl-2-pyrrolidone, 1,3-dimethylimidazolidinone, Ecaprolactam, and γ-butyrolactone; amides, such as formamide, N-methylformamide, and N,N-dimethylformamide; amines, such as monoethanolamine, diethanolamine, and triethylamine; sulfur-containing compounds, such as dimethyl sulfoxide, sulfolane, and thiodiethanol; propylene carbonate, and ethylene carbonate. The above-listed examples may be used alone or in combination.

The proportion of the organic solvent in the aqueous clear ink has no particular limit and can be suitably selected to suit a particular application. In terms of the drying property and discharging reliability of the ink, the proportion is preferably from 10% by mass to 60% by mass and more preferably from 20% by mass to 60% by mass.

The aqueous clear ink may optionally include, as other components, such as a defoaming agent, a preservative and fungicide, a corrosion inhibitor, and a pH regulator.

—Defoaming Agent—

The defoaming agent has no particular limit. For example, silicone-based defoaming agents, polyether-based defoaming agents, and aliphatic acid ester-based defoaming agents are suitable. These can be used alone or in combination. Of these, silicone-based defoaming agents are preferable to easily break foams.

—Preservatives and Fungicides—

The preservative and fungicide are not particularly limited. A specific example is 1,2-benzisothiazolin-3-one.

—Corrosion Inhibitor—

The corrosion inhibitor has no particular limit. Examples thereof are acid sulfite and sodium thiosulfate.

—pH Regulator—

The pH regulator has no particular limit. It is preferable to adjust the pH to 7 or higher. Specific examples thereof include, but are not limited to, amines, such as diethanol amine and triethanol amine.

The property of the aqueous clear ink is not particularly limited and may be appropriately selected depending on the intended purpose. For example, viscosity, surface tension, pH, etc., are preferable in the following ranges.

The viscosity of the ink at 25 degrees Celsius is preferably from 5 mPa·s to 30 mPa·s and more preferably from 5 mPa·s to 25 mPa·s to improve print density and text quality and obtain good dischargeability. The viscosity can be measured by, for example, a rotatory viscometer (RE-80L, manufactured by TOKI SANGYO CO., LTD.). The measuring conditions are as follows:

Standard cone rotor (1 degree 34'×R24)

Sample liquid amount: 12 mL

Number of rotations: 50 rotations per minute (rpm)

25 degrees Celsius

Measuring time: three minutes

The surface tension of the aqueous ink is preferably 35 mN/m or less and more preferably 32 mN/m or less at 25 degrees Celsius in terms that the ink is suitably levelized on a print medium and the drying time of the ink is shortened.

The pH of the aqueous clear ink is preferably from 7 to 12 and more preferably from 8 to 11 in terms of prevention of corrosion of metal materials contacting the ink.

<Material to be Printed>

The material to be printed is not limited to materials used as recording media. For example, building materials (e.g., wall paper, floor materials, and tiles), cloth for apparel (e.g., T-shirts), textiles, and leather are appropriately applied as the material to be printed. Note that, ceramics, glass, or metals may be also used as the material to be printed by adjusting a structure of a path where a print medium is transported The print medium is not particularly limited. Plain paper, gloss paper, special paper, or cloth may be used as the recording material, but image formation can be also excellently performed using a non-permeable base.

The non-permeable base is a base having a surface of low water permeation and absorption. The non-permeable base includes a material where a number of yids are included inside the material but the voids are not exposed to the surfaces of the material. More quantitatively, the non-permeable base is a base having water absorption of 10 $mL/m^2$ or less determined from the starting of contact to 30 $msec^{1/2}$.

As the non-permeable base, for example, a plastic film, such as a vinyl chloride resin film, a polyethylene terephthalate (PET) film, an acrylic resin film, a polypropylene film, a polyethylene film, and polycarbonate film, is suitably used.

In the present disclosure, a material to be printed having high glossiness is preferably used with the matte gloss printing mode. Use of the material having high glossiness is preferable because a matte gloss effect obtainable by the clear ink can be easily enhanced.

On the other hand, a material to be printed having low glossiness is preferably used with the gloss printing mode. Use of the material having low glossiness is preferable because a gloss effect obtainable by the clear ink can be easily enhanced. Accordingly, the following formula $G_{matte}>G_{gloss}$ is preferably satisfied and the following formula $G_{matte}-G_{gloss}\geq 100$ is more preferably satisfied where $G_{matte}$ is glossiness of the material to be printed used for the matte gloss printing mode, and $G_{gloss}$ is glossiness of the material to be printed used for the gloss printing mode.

(Method for Controlling Glossiness of Printed Image)

The method for controlling glossiness of a printed image is a method including ejecting an ink to a material to be printed to form a print layer and heating the printed material to be printed. The ink is an aqueous clear ink including a resin and water. The method has a matte gloss printing mode that is a printing mode for imparting matte gloss, and a gloss printing mode that is a printing mode for imparting gloss. The heating is controlled to increase a heating temperature when printing is performed with the matte gloss printing mode. The heating is controlled to decrease the heating temperature when printing is performed with the gloss printing mode.

(Printed Matter)

The printed matter of the present disclosure includes a material to be printed and a print layer disposed on the material to be printed. The print layer includes a clear ink layer including a resin. The printed matter includes a matte printed image printed with a matte gloss printing mode and a gloss printed image printed with a gloss printing mode. A glossiness difference (Ga−Gb) between 60 degrees glossiness Ga of the gloss printed image and 60 degrees glossiness Gb of the material to be printed used for the gloss printing mode is 20 or greater. A glossiness difference (Gc−Gd) between 60 degrees glossiness Gc of the matte printed image and 60 degrees glossiness Gd of the material to be printed used for the matte printing mode is −20 or less.

Printed matter may be obtained by performing image formation by means of the inkjet printing device according to the inkjet printing method.

<Printing Device and Printing Method>

The printing device and the printing method will be described as a case where a black (K) ink, a cyan (C) ink, a magenta (M) ink, and a yellow (Y) ink are used, hereinafter. However, an aqueous clear ink may be used instead of or in addition to the black (K) ink, the cyan (C) ink, the magenta (M) ink, and the yellow (Y) ink.

The aqueous clear ink for use in the present disclosure can be suitably used for various printing devices according to an inkjet printing system, such as a printer, a facsimile, a photocopier, printer/fax/copier multifunction peripheral, and a 3D printer. The inkjet printing device may be a serial type device where an inkjet head is moved, or a line-type device where an ejection head is not moved, unless otherwise stated. Furthermore, in addition to the desktop type, the inkjet printing device includes a wide printing device, or a continuous printer capable of using continuous paper wound up in a roll form as print media.

In the present disclosure, the printing device and the printing method represent a device capable of discharging an ink, various processing fluids, etc. to a print medium and a method printing an image on the print medium using the device. The print medium means an article to which the ink or the various processing fluids can be attached at least temporarily.

The printing device may further optionally include a device relating to feeding, transferring, and ejecting the print medium and other devices referred to as a pre-processing device, a post-processing device, etc. in addition to the head portion to discharge the ink.

In addition, the printing device and the printing method are not limited to those producing merely meaningful visible images such as texts and figures with the ink. For example, the printing device and the printing method can produce patterns like geometric design and 3D images.

In addition, the printing device includes both a serial type device in which the liquid discharging head is caused to move and a line type device in which the liquid discharging head is not moved, unless otherwise specified.

Furthermore, in addition to the desktop type, this printing device includes a wide type capable of printing images on a large print medium such as AO, a continuous printer capable of using continuous paper wound up in a roll form as print media.

Figure 2:
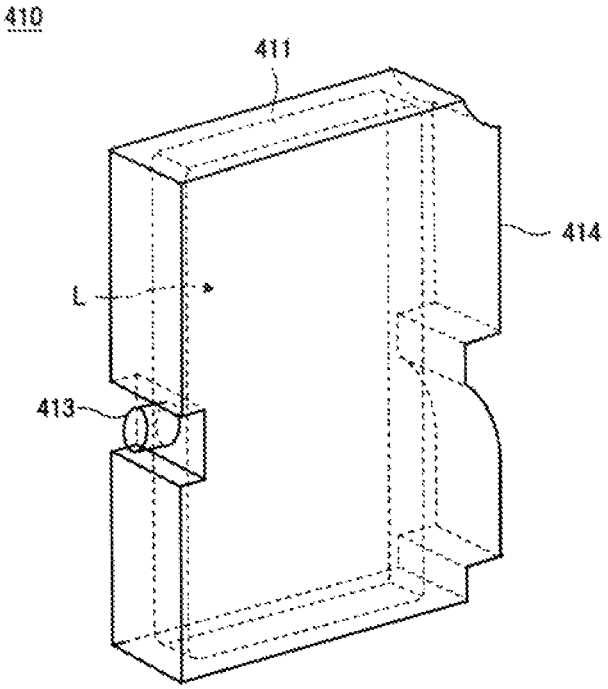
FIG. 2 is a perspective view illustrating an example of a main tank of the image forming apparatus of FIG. 1.

The printing device of the present disclosure is described using an example with reference to FIG. 1 and FIG. 2. FIG. 1 is a perspective view illustrating the image printing device. FIG. 2 is a perspective view illustrating the main tank. An image forming apparatus 400 as an example of the printing device is a serial type image forming apparatus. A mechanical unit 420 is disposed in an exterior 401 of the image forming apparatus 400. Each ink accommodating unit (ink container) 411 of each main tank 410 (410*k*, 410*c*, 410*m*, and 410*y*) for each color of black (K), cyan (C), magenta (M), and yellow (Y) is made of a packing member such as an aluminium laminate film. The ink container 411 is accommodated in a plastic housing unit 414. As a result, the main tank 410 is used as an ink cartridge of each color.

A cartridge holder 404 is disposed on the rear side of the opening when a cover 401*c* is opened. The cartridge holder 404 is detachably attached to the main tank 410. As a result, each ink discharging outlet 413 of the main tank 410 is communicated with a discharging head 434 for each color via a supplying tube 436 for each color so that the ink can be discharged from the discharging head 434 to a print medium.

This printing device may include not only a portion discharging ink but also a device referred to as a pre-processing device, a post-processing device, etc.

As an example of the pre-processing device and the post-processing device, as in the case of the ink such as black (K), cyan (C), magenta (M), and yellow (Y), a liquid container containing a pre-processing fluid or a post-processing fluid and a liquid discharging head are added to discharge the pre-processing fluid or the post-processing fluid in an inkjet printing method.

As another example of the pre-processing device and the post-processing device, it is suitable to dispose a pre-processing device and a post-processing device employing a blade coating method, a roll coating method, or a spray coating method other than the inkjet printing method.

How to use the ink is not limited to the ink printing method. Specific examples of such methods other than the inkjet printing method include, but are not limited to, blade coating methods, gravure coating methods, bar coating methods, roll coating methods, knife coating methods, dip coating methods, die coating methods, and spray coating methods.

The applications of the ink of the present disclosure are not particularly limited. For example, the ink can be used for printed matter, a print, a coating material, and foundation. The ink can be used to form two-dimensional texts and images and furthermore a three-dimensional solid object (3D modeling object) as a material for 3D modeling.

An apparatus for fabricating a three-dimensional object can be any known device with no particular limit. For example, the apparatus includes an ink container, a supplying device, a discharging device, a drier, etc. The three-dimensional solid object includes an object manufactured by re-applying ink. In addition, the three-dimensional solid object can be manufactured by processing a structure having a substrate such as a print medium printed with the ink as a modeled processed product. The modeled processed product is fabricated by, for example, heating drawing or punching a structure or printed matter having a sheet-like form, film-like form, etc. For example, the ink can be suitably used for the application of forming after decorating a surface, such as panels of meters or control units of cars, OA appliances, electric or electronic devices, cameras, etc.

Moreover, image forming, recording, printing, etc. in the present disclosure represent the same meaning.

A print medium, a medium, and a material to be printed represent the same meaning.

EXAMPLES

The present disclosure will be described more detail by way of Examples. However, the present disclosure should not be construed as being limited to these Examples.

Preparation Example 1

<Preparation of Polycarbonate-Based Polyurethane Resin Emulsion 1>

A reaction vessel equipped with a stirrer, a reflux condenser, and a thermometer was charged with 1,500 parts by mass of polycarbonate diol (a reaction product between 1,6-hexanediol and dimethyl carbonate (number average molecular weight (Mn): 1,200), 220 parts by mass of 2,2-dimethylolpropionic acid (may be referred to as "DMPA" hereinafter), and 1,347 parts by mass of N-methylpyrrolidone (may be referred to as "NMP" hereinafter) under a nitrogen flow, and the resultant mixture was heated at 60 degrees Celsius to dissolve DMPA.

Next, 1,445 parts by mass of 4,4'-dicyclohexylmethanediixocyanate and 2.6 parts by mass of dibutyl tin laurate (catalyst) were added, and the resultant mixture was heated at 90 degrees Celsius to perform an urethanation reaction for 5 hours, to thereby obtain a urethane prepolymer including an isocyanate terminal. The resultant reaction mixture was cooled to 80 degrees Celsius. To the reaction mixture, 149 parts by mass of trimethylamine was added and mixed. From the resultant mixture, 4,340 parts by mass of the mixture was taken out. The mixture was then added to a mixed solution including 5,400 parts by mass of water and 15 parts by mass of trimethylamine with strongly stirring.

Next, to the resultant, 1,500 parts by mass of ice was added, and 626 parts by mass of a 35% by mass 2-methyl-1,5-pentanediamine aqueous solution were added to perform a chain extension reaction. Then, the solvent was removed to obtain a solid content of 30% by mass, to thereby obtain Polycarbonate-Based Polyurethane Resin Emulsion 1.

The obtained polycarbonate-based polyurethane resin emulsion was measured by a "film formation temperature tester" (available from Imoto Machinery Co., Ltd.). As a result, the minimum film formation temperature was 55 degrees Celsius.

Preparation Example 2

<Preparation of Acrylic Resin Emulsion 1>

A reaction vessel equipped with a stirrer, a reflux condenser, a dripping device, and a thermometer was charged with 900 parts of ion-exchanged water and 1 part by mass of sodium lauryl sulfate, and the resultant mixture was heated to 70 degrees Celsius with stirring while purging the reaction vessel with nitrogen. The internal temperature of the reaction vessel was maintained at 70 degrees Celsius, and 4 parts by mass of potassium persulfate was added as a polymerization initiator to the mixture and dissolved therein. An emulsion that was produced in advance by adding 450 parts by mass of ion-exchanged water, 3 parts by mass of sodium lauryl sulfate, 20 parts by mass of acrylamide, 365 parts by mass of styrene, 545 parts by mass of butyl acrylate, and 10 parts by mass of methacrylic acid together with stirring was dripped into the reaction solution in the reaction vessel for 4 hours. After completing the dripping, the reaction was maintained for 3 hours. After cooling the obtained aqueous emulsion to room temperature, ion-exchanged water and a sodium hydroxide aqueous solution were added to the aqueous emulsion to adjust pH thereof to 8, to thereby obtain Acrylic Resin Emulsion 1 (solid content: 30% by mass).

Production Example 1

—Production of Aqueous Clear Ink A—

A mixture was prepared by adding 25% by mass of Polyurethane Resin Emulsion 1 (solid content: 30% by mass) of Preparation Example 1, 19% by mass of 1,2-propanediol, 11% by mass of 1,3-propanediol, 3% by mass of 1,2-butanediol, 6% by mass of a surfactant, the product name of FS-300 (fluorosurfactant, available from E.I. du Pont de Nemours & Company, solid content: 40% by mass), and 36% by mass of ultra pure water together, and mixing and stirring the resultant mixture.

Next, the obtained mixture was filtered with a polypropylene filter having an average pore size of 0.2 micrometers (product name: Betafine polypropylene pleated filter PPG series, available from 3M), to thereby produce Aqueous Clear Ink A.

Production Examples 2 to 5

—Production of Aqueous Clear Inks B to E—

Aqueous Clear Inks B to E were each produced in the same manner as in Production Example 1, except that the ink composition was changed to the ink composition presented in Table 1.

TABLE 1

| | | Production Example 1 Aqueous Clear Ink A | Production Example 2 Aqueous Clear Ink B | Production Example 3 Aqueous Clear Ink C | Production Example 4 Aqueous Clear Ink D | Production Example 5 Aqueous Clear Ink E |
|---|---|---|---|---|---|---|
| Resin | Polyurethane Resin Emulsion 1 (water dispersible, solid content: 30% by mass) | 25 | 30 | 30 | 40 | — |
| | Acrylic Resin Emulsion 1 (water dispersible, solid content: 30% by mass) | — | — | — | | 40 |
| Water | ultra pure water | 36 | 32.6 | 33.5 | 26.5 | 26.6 |
| Surfactant | FS-300/ available from DuPont (solid content: 40% by mass) | 6 | 6 | 4.5 | 4.5 | 4.6 |
| Organic solvent | 1,2-propanediol | 19 | 17.4 | 18 | 15 | 15 |
| | 1,3-propanediol | 11 | 11 | 11 | 11 | 11 |
| | 1,2-butanediol | 3 | 3 | 3 | 3 | 3 |
| Total (mass %) | | 100 | 100 | 100 | 100 | 100 |
| Solid content of resin in aqueous clear ink (mass %) | | 7.6 | 9 | 9 | 12 | 12 |

Production Example 6

—Production of Magenta Ink—

<Preparation of Self-Dispersible Magenta Pigment Dispersion>

After premixing a mixture of the following composition, the resultant mixture was circulated and dispersed by means of a disk-type bead mill (available from SHINMARU ENTERPRISES CORPORATION, KDL-type, media: using zirconia beads each having a diameter of 0.3 mm) for 7 hours, to thereby obtain a self-dispersible magenta pigment dispersion (pigment solid content: 15% by mass).

Pigment Red 122 (product name: Toner Magenta E002, available from Clamant Japan K.K.): 15 parts by mass Anionic surfactant (product name: Pionin A-51-B, available from TAKEMOTO OIL & FAT Co., Ltd.): 2 parts by mass Ion-exchanged water: 83 parts by mass <Production of Magenta Ink>

Polyurethane Resin Emulsion 1 (solid content: 30% by mass) of Preparation Example 1 in the amount of 25% by mass, 20% by mass of the self-dispersible magenta pigment dispersion (pigment solid content: 15% by mass), 20% by mass of 1,2-propanediol, 11% by mass of 1,3-propanediol, 3% by mass of 1,2-butanediol, 6% by mass of FS-300 (product name) (fluorosurfactant, available from E.I. du Pont de Nemours & Company, solid content: 40% by mass) serving as a surfactant, and 15% by mass of ultra pure water were added together, mixed, and stirred, to thereby prepare a mixture.

The obtained mixture was filtered through a polypropylene filter having the average pore diameter of 0.2 micrometers (product name: Betafine polypropylene pleated filter PPG series, available from 3M), to thereby produce a magenta ink.

Example 1

<Inkjet Printing>

An ink cartridge of a modified device of an inkjet printer GXe5500 (available from Ricoh Company Limited) was loaded with Aqueous Clear Ink A of Production Example 1, and the ink cartridge loaded with the ink was mounted in the modified device of the inkjet printer GXe5500 to perform inkjet printing.

A heater (temperature adjusting controller, model MTCD, available from MISUMI Corporation) was disposed in the modified device of the inkjet printer GXe5500 in a manner that a print medium could be heated from a back surface thereof before, during, and after printing. As a result, printing could be performed on a printing medium heated before and during printing by the heater, and the printed matter could be heated and dried by the heater after printing.

Printing was performed with changing a type of a print medium for use, heating conditions, and a printing image according to the gloss printing mode and the matte gloss printing mode.

—Print Medium—

In the gloss printing mode, synthetic paper VJFN160 (available from YUPO CORPORATION, white polypropylene film, glossiness (60 degrees gloss value): 16) was used as Print Medium 1.

In the matte printing mode, a window film GIY-0305 (available from LINTEC SIGN SYSTEM, INC., transparent polyethylene terephthalate (PET) film, glossiness (60 degrees gloss value): 159) was used as Print Medium 2.

—Heating Conditions—

The heating conditions in the gloss printing mode were set by setting a heating temperature of the heater (heating unit) disposed before, during, and after printing to 60 degrees Celsius, 60 degrees Celsius, and 70 degrees Celsius, respectively. In the matte gloss printing mode, the heating temperature of the heater (heating unit) disposed before, during, and after printing was set to 65 degrees Celsius, 65 degrees Celsius, and 70 degrees Celsius, respectively. When the temperature of the print medium during the printing was measured, the print medium temperature (=$T_{gloss}$) with the gloss printing mode was 59 degrees Celsius and the temperature of the heating unit (=$HT_{gloss}$ (degrees Celsius)) with the gloss printing mode during printing was 60 degrees Celsius. When the temperature of the print medium during the printing was measured, the print medium temperature (=$T_{matte}$) in the matte gloss printing mode was 64 degrees Celsius and the temperature of the heating unit (=$HT_{matte}$ (degrees Celsius)) with the matte printing mode during printing was 65 degrees Celsius.

The temperature of the print medium during printing was measured by means of a digital radiation temperature sensor FT-H10 (available from KEYENCE CORPORATION).

The image printed with the gloss printing mode was a solid image having image resolution of 600 dpi×600 dpi and a printing rate of 100%.

The image printed with the matte gloss printing mode was a half-tone image having image resolution of 600 dpi×600 dpi and a printing rate of 40%.

—Printing Rate—

Note that, the printing rate means as follows.

Printing rate (%)=the number of printed dots of clear ink/(vertical resolution×horizontal resolution)×100

(in the formula above, "the number of printed dots of clear ink" is the number of dots formed per unit area by actually printing the clear ink, "vertical resolution" and "horizontal resolution" are each resolution per unit area, and in the case where the clear ink is printed to overlap to form dots on the same positions, "the number of printed dots of clear ink" represents the total number of dots formed per unit area by actually printing the clear ink.)

In both the matte gloss printing mode, and the gloss printing mode, printing was performed in a manner that Aqueous Clear Ink A was overlapped once to superimpose dots in the same positions.

Next, glossiness of the obtained printed matter was measured in the following manner. The results are presented in Table 3.

<Glossiness>

A 60 degrees gloss value of the clear ink printed area on which Aqueous Clear Ink A had been printed and a 60 degrees gloss value of the cleat ink unprinted area (print medium) on which Aqueous Clear Ink A had not been printed were measured by means of a gloss meter (Micro-tri-gloss, available from BYK Japan KK). Note that, the 60 degrees gloss value was determined as glossiness.

Example 2

Inkjet printing was performed in the same manner as in Example 1, except that the image printed with the gloss printing mode was changed to a half-tone image having image resolution of 600 dpi×600 dpi and a printing rate of 80%, and the image printed with the matte gloss printing mode was changed to a half-tone image having image resolution of 600 dpi×600 dpi and a printing rate of 70%.

Glossiness of the obtained printed matter was measured in the same manner as in Example 1. The results are presented in Table 3.

Example 3

Inkjet printing was performed in the same manner as in Example 1, except that the heating conditions were changed in a manner that heating temperatures of the heater disposed before, during, and after printing were set to 50 degrees Celsius, 50 degrees Celsius, and 70 degrees Celsius, respectively, in the gloss printing mode, and heating temperature of the heater disposed before, during, and after printing were set 70 degrees Celsius, 70 degrees Celsius, and 70 degrees Celsius, respectively in the matte gloss printing. Glossiness of the obtained printed matter was measured in the same manner as in Example 1. The results are presented in Table 3.

When the print medium temperature during the printing was measured, the print medium temperature (=$T_{gloss}$) was 49 degrees Celsius with the gloss printing mode, and the temperature of the heating unit (=$HT_{gloss}$ (degrees Celsius)) with the gloss printing mode during printing was 50 degrees Celsius. When the print medium temperature during the printing was measured, moreover, the print medium temperature (=$T_{matte}$) was 68 degrees Celsius in the matte printing mode and the temperature of the heating unit (=$HT_{matte}$ (degrees Celsius)) with the matte gloss printing mode during printing was 70 degrees Celsius.

Example 4

Inkjet printing was performed in the same manner as in Example 3, except that Aqueous Clear Ink A of Production Example 1 was replaced with Aqueous Clear Ink B of Production Example 2.

Glossiness of the obtained printed matter was measured in the same manner as in Example 1. The results are presented in Table 3.

Example 5

Inkjet printing was performed in the same manner as in Example 3, except that Aqueous Clear Ink A of Production Example 1 was replaced with Aqueous Clear Ink C of Production Example 3.

Glossiness of the obtained printed matter was measured in the same manner as in Example 1. The results are presented in Table 3.

Example 6

Inkjet printing was performed in the same manner as in Example 3, except that Aqueous Clear Ink A of Production Example 1 was replaced with Aqueous Clear Ink D of Production Example 4.

Glossiness of the obtained printed matter was measured in the same manner as in Example 1. The results are presented in Table 3.

Example 7

Inkjet printing was performed in the same manner as in Example 3, except that Aqueous Clear Ink A of Production Example 1 was replaced with Aqueous Clear Ink E of Production Example 5.

Glossiness of the obtained printed matter was measured in the same manner as in Example 1. The results are presented in Table 3.

Example 8

Inkjet printing was performed in the same manner as in Example 7, except that a print medium on which the magenta ink of Production Example 6 had been printed was used. Specifically, the clear ink was printed on a coating film formed by printing the magenta ink.

As the magenta ink printed on the print medium, the magenta ink of Production Example 6 was used. A printing device identical to the printing device used for the clear ink was used for printing of the magenta ink. In order to form a coating film of the magenta ink using the gloss printing mode, only the magenta ink was printed on a print medium by setting the heating temperatures of the heaters before, during, and after printing to 50 degrees Celsius, 50 degrees Celsius, and 70 degrees Celsius, respectively. In order to form a coating film of the magenta ink using the matte gloss printing mode, only the magenta ink was printed on a print medium by setting the heating temperatures of the heaters to 70 degrees Celsius, 70 degrees Celsius, and 70 degrees Celsius, respectively. As each of the printed images of the magenta, a solid image having image resolution of 600 dpi×600 dpi and a printing rate of 100% was printed.

The obtained print medium on which the coating film of the magenta ink had been printed was again subjected to printing of the clear ink by means of the printing device. Glossiness of the obtained printed matter was measured in the same manner as in Example 1. The results are presented in Table 3.

Comparative Example 1

Inkjet printing was performed in the same manner as in Example 2, except that the temperatures of the heater with the gloss printing mode were set to 65 degrees Celsius, 65 degrees Celsius, and 70 degrees Celsius, respectively, which were identical to the temperature setting of the heaters in the matte gloss printing mode. Glossiness of the obtained printed matter was measured in the same manner as in Example 1. The results are presented in Table 3.

When the print medium temperature during the printing was measured, the print medium temperature (=$T_{gloss}$) was 64 degrees Celsius in the gloss printing mode and the temperature of the heating unit (=$HT_{gloss}$ (degrees Celsius)) with the gloss printing mode during the printing was 65 degrees Celsius. When the print medium temperature during the printing was measured, moreover, the print medium temperature (=$T_{matte}$) was 64 degrees Celsius in the matte printing mode, and the temperature of the heating unit (=HTmatte (degrees Celsius)) with the matte glossprinting mode during the printing was 65 degrees Celsius.

Comparative Example 2

Inkjet printing was performed in the same manner as in Example 1, except that the temperature setting of the heater in the gloss printing mode was set to 65 degrees Celsius, 65 degrees Celsius, and 70 degrees Celsius, respectively, which were identical to the temperature setting of the heaters in the matte gloss printing mode.

Glossiness of the obtained printed matter was measured in the same manner as in Example 1. The results are presented in Table 3.

When the print medium temperature during the printing was measured, the print medium temperature (=$T_{gloss}$) was 64 degrees Celsius in the gloss printing mode, and the temperature of the heating unit (=$HT_{gloss}$ (degrees Celsius)) with the gloss printing mode during the printing was 65 degrees Celsius. When the print medium temperature during the printing was measured, moreover, the print medium temperature (=$T_{matte}$) was 64 degrees Celsius in the matte printing mode, and the temperature of the heating unit (=$HT_{matte}$ (degrees Celsius)) with the matte gloss printing mode during the printing was 65 degrees Celsius.

Comparative Example 3

The magenta ink of Production Example 6 was printed on a print medium. A printing device identical to the printing device used for the clear ink was used for printing of the magenta ink. In order to form a coating film of the magenta ink using the gloss printing mode, only the magenta ink was printed on a print medium by setting the heating temperatures of the heater before, during, and after printing to 50 degrees Celsius, 50 degrees Celsius, and 70 degrees Celsius, respectively. In order to form a coating film of the magenta ink using the matte gloss printing mode, only the magenta ink was printed on a print medium by setting the heating temperatures of the heater before, during, and after the printing to 70 degrees Celsius, 70 degrees Celsius, and 70 degrees Celsius, respectively.

Glossiness of the printed matter was measured in the same manner as in Example 1. The results are presented in Table 3.

As each of the printed images of the magenta, a solid image having image resolution of 600 dpi×600 dpi and a printing rate of 100% was printed.

The glossiness of the area of the coated film of the magenta ink in the gloss printing mode was 30 (glossiness of the background on the medium=16), and the glossiness of the area of the coated film of the magenta ink in the matte gloss printing mode was 102 (glossiness of the background on the medium=159).

Comparative Example 4

Inkjet printing was performed in the same manner as in Comparative Example 2, except that the temperatures of the heater before, during, and after the printing with the matte gloss printing mode were set to 60 degrees Celsius, 60 degrees Celsius, and 70 degrees Celsius, respectively.

Glossiness of the obtained printed matter was measured in the same manner as in Example 1. The results are presented in Table 3.

TABLE 2

| | Printing conditions | | | | | | | | | |
|---|---|---|---|---|---|---|---|---|---|---|
| | | | | | | | | set temperature of heater | | |
| | ink | printing mode | print medium | printing image | printing area of clear ink | printing rate | number of overlap of clear ink | heater before printing | heater during printing ($HT_{gloss}$, $HT_{matte}$) | heater after printing |
| Ex. 1 | Clear Ink A | gloss | VJFN160 | solid image | print medium | 100% | once | 60° C. | 60° C. | 70° C. |
| | | matte | GIY0305 | half tone image | print medium | 40% | once | 65° C. | 65° C. | 70° C. |

TABLE 2-continued

| | Printing conditions | | | | | | | | | |
|---|---|---|---|---|---|---|---|---|---|---|
| | | | | | | | | set temperature of heater | | |
| | ink | printing mode | print medium | printing image | printing area of clear ink | printing rate | number of overlap of clear ink | heater before printing | heater during printing ($HT_{gloss}$, $HT_{matte}$) | heater after printing |
| Ex. 2 | Clear Ink A | gloss | VJFN160 | half tone image | print medium | 80% | once | 60° C. | 60° C. | 70° C. |
| | | matte | GIY0305 | half tone image | print medium | 70% | once | 65° C. | 65° C. | 70° C. |
| Ex. 3 | Clear Ink A | gloss | VJFN160 | solid image | print medium | 100% | once | 50° C. | 50° C. | 70° C. |
| | | matte | GIY0305 | half tone image | print medium | 40% | once | 70° C. | 70° C. | 70° C. |
| Ex. 4 | Clear Ink B | gloss | VJFN160 | solid image | print medium | 100% | once | 50° C. | 50° C. | 70° C. |
| | | matte | GIY0305 | half tone image | print medium | 40% | once | 70° C. | 70° C. | 70° C. |
| Ex. 5 | Clear Ink C | gloss | VJFN160 | solid image | print medium | 100% | once | 50° C. | 50° C. | 70° C. |
| | | matte | GIY0305 | half tone image | print medium | 40% | once | 70° C. | 70° C. | 70° C. |
| Ex. 6 | Clear Ink D | gloss | VJFN160 | solid image | print medium | 100% | once | 50° C. | 50° C. | 70° C. |
| | | matte | GIY0305 | half tone image | print medium | 40% | once | 70° C. | 70° C. | 70° C. |
| Ex. 7 | Clear Ink E | gloss | VJFN160 | solid image | print medium | 100% | once | 50° C. | 50° C. | 70° C. |
| | | matte | GIY0305 | half tone image | print medium | 40% | once | 70° C. | 70° C. | 70° C. |
| Ex. 8 | Clear Ink E + magenta ink | gloss | VJFN160 | solid image | magenta ink coating film | 100% | once | 50° C. | 50° C. | 70° C. |
| | | matte | GIY0305 | half tone image | magenta ink coating film | 40% | once | 70° C. | 70° C. | 70° C. |
| Comp. Ex. 1 | Clear Ink A | gloss | VJFN160 | half tone image | print medium | 80% | once | 65° C. | 65° C. | 70° C. |
| | | matte | GIY0305 | half tone image | print medium | 70% | once | 65° C. | 65° C. | 70° C. |
| Comp. Ex. 2 | Clear Ink A | gloss | VJFN160 | solid image | print medium | 100% | once | 65° C. | 65° C. | 70° C. |
| | | matte | GIY0305 | half tone image | print medium | 40% | once | 65° C. | 65° C. | 70° C. |
| Comp. Ex. 3 | Magenta Ink | gloss | VJFN160 | solid image | unprinted | 100% | | 50° C. | 50° C. | 70° C. |
| | | matte | GIY0305 | solid image | unprinted | 100% | | 70° C. | 70° C. | 70° C. |
| Comp. Ex. 4 | Clear Ink A | gloss | VJFN160 | solid image | print medium | 100% | once | 65° C. | 65° C. | 70° C. |
| | | matte | GIY0305 | half tone image | print medium | 40% | once | 60° C. | 60° C. | 70° C. |

TABLE 3

| | Evaluation results | | | | |
|---|---|---|---|---|---|
| | | | glossiness | | |
| | temperature of print medium during printing | | clear ink printed area | clear ink unprinted | glossiness difference printed area − unprinted area |
| Ex. 1 | $T_{gloss}$ | 59° C. | 57 | 16 | 41 |
| | $T_{matte}$ | 64° C. | 110 | 159 | −49 |
| Ex. 2 | $T_{gloss}$ | 59° C. | 40 | 16 | 24 |
| | $T_{matte}$ | 64° C. | 130 | 159 | −29 |
| Ex. 3 | $T_{gloss}$ | 49° C. | 65 | 16 | 49 |
| | $T_{matte}$ | 68° C. | 102 | 159 | −57 |
| Ex. 4 | $T_{gloss}$ | 49° C. | 68 | 16 | 52 |
| | $T_{matte}$ | 68° C. | 95 | 159 | −64 |
| Ex. 5 | $T_{gloss}$ | 49° C. | 66 | 16 | 50 |
| | $T_{matte}$ | 68° C. | 84 | 159 | −75 |

TABLE 3-continued

| | Evaluation results | | | | |
|---|---|---|---|---|---|
| | | | glossiness | | |
| | temperature of print medium during printing | | clear ink printed area | clear ink unprinted | glossiness difference printed area − unprinted area |
| Ex. 6 | $T_{gloss}$ | 49° C. | 70 | 16 | 54 |
| | $T_{matte}$ | 68° C. | 77 | 159 | −82 |
| Ex. 7 | $T_{gloss}$ | 49° C. | 71 | 16 | 55 |
| | $T_{matte}$ | 68° C. | 82 | 159 | −77 |
| Ex. 8 | $T_{gloss}$ | 49° C. | 85 | 30 | 55 |
| | $T_{matte}$ | 68° C. | 38 | 102 | −64 |
| Comp. Ex. 1 | $T_{gloss}$ | 64° C. | 30 | 16 | 14 |
| | $T_{matte}$ | 64° C. | 140 | 159 | −19 |
| Comp. Ex. 2 | $T_{gloss}$ | 64° C. | 35 | 16 | 19 |
| | $T_{matte}$ | 64° C. | 138 | 159 | −21 |

TABLE 3-continued

| | Evaluation results | | | | |
|---|---|---|---|---|---|
| | | | glossiness | | |
| | temperature of print medium during printing | | clear ink printed area | clear ink unprinted | glossiness difference printed area − unprinted area |
| Comp. Ex. 3 | $T_{gloss}$ | 64° C. | — | — | — |
| | $T_{matte}$ | 64° C. | — | — | — |
| Comp. Ex. 4 | $T_{gloss}$ | 64° C. | 35 | 16 | 19 |
| | $T_{matte}$ | 59° C. | 143 | 159 | −16 |

*In Table 3, the result "—" of the glossiness of Comparative Example 3 means that glossiness cannot be measured.

It was found from the results of Tables 2 and 3 that the glossiness was significantly reduced in the matte gloss printing mode and the gloss was significantly increased in the gloss printing mode in Examples 1 to 8 where $T_{matte}>T_{gloss}$ ($HT_{matte}>HT_{gloss}$), compared with Comparative Examples 1 and 2 where $T_{matte}=T_{gloss}$ ($HT_{matte}=HT_{gloss}$) and Comparative Example 4 where $T_{matte}<T_{gloss}$ ($HT_{matte}<HT_{gloss}$).

It was found from the comparison between Example 1 and Example 2 that a large gloss change was obtained in Example 1 where $D_{gloss}-D_{matte}$ was 60%, compared with Example 2 where $D_{gloss}-D_{matte}$ was 10%.

It was found from the comparison between Example 3, Example 4, and Example 6 that the larger amount of the resin in the aqueous clear ink lead to the larger gloss change, and the large gloss change was obtained in Examples 4 and 6 where the amount of the resin in the aqueous clear ink was 8% by mass or greater, compared with Example 3 where the amount of the resin in the aqueous clear ink was less than 8% by mass.

It was found from the comparison between Example 4 and Example 5 that the large gloss change was obtained in the matte gloss mode in Example 5 where the amount of the surfactant was 2% by mass or less compared with Example 4 where the amount of the surfactant was greater than 2% by mass.

It was found from the comparison between Example 8 and Comparative Example 3 that the excellent matte finish in the matte gloss mode and the higher gloss in the gloss mode were obtained when the clear ink was printed on the magenta ink coated film, as in Example 8, compared with the case where the magenta ink alone was printed, as in Comparative Example 3.

For example, embodiments of the present disclosure are as follows.

<1> An inkjet printing device including:

an ink storage unit configured to store an ink;

an ejection head configured to eject the ink to form a print layer; and a heating unit configured to heat a material to be printed, wherein the ink is an aqueous clear ink including a resin and water, the inkjet printing device has a low gloss printing mode that is a printing mode for imparting low gloss, and a high gloss printing mode that is a printing mode for imparting high gloss, and the heating unit is configured to heat to satisfy the following formula $T_{matte}>T_{gloss}$, where $T_{matte}$ (degrees Celsius) is a temperature of a low gloss printing region of the material to be printed where the low gloss printing region is printed with the low gloss printing mode when the aqueous clear ink is deposited on the material to be printed, and $T_{gloss}$ (degrees Celsius) is a temperature of a high gloss printing region of the material to be printed where the high gloss printing region is printed with the high gloss printing mode when the aqueous clear ink is deposited on the material to be printed.

<2> The inkjet printing device according to <1>, wherein the heating unit is configured to heat to satisfy the following formula $T_{matte}-T_{gloss}\geq 10$ degrees Celsius.

<3> An inkjet printing device including:

an ink storage unit configured to store an ink;

an ejection head configured to eject the ink to form a print layer; and a heating unit configured to heat a material to be printed, wherein the ink is an aqueous clear ink including a resin and water, the inkjet printing device has a low gloss printing mode that is a printing mode for imparting low gloss, and a high gloss printing mode that is a printing mode for imparting high gloss, and the heating unit is configured to heat to satisfy the following formula $HT_{matte}>HT_{gloss}$, where $HT_{matte}$ (degrees Celsius) is a temperature of the heating unit with the low gloss printing mode and $HT_{gloss}$ (degrees Celsius) is a temperature of the heating unit with the high gloss printing mode.

<4> The inkjet printing device according to any one of <1> to <3>, wherein the following formula $G_{matte}>G_{gloss}$ is satisfied, where $G_{matte}$ is glossiness of the material to be printed used for the low gloss printing mode, and $G_{gloss}$ is glossiness of the material to be printed used for the high gloss printing mode.

<5> The inkjet printing device according to any one of <1> to <4>, wherein an amount of the resin in the aqueous clear ink is 9% by mass or greater.

<6> The inkjet printing device according to any one of <1> to <5>, wherein the resin is a polyurethane resin.

<7> The inkjet printing device according to any one of <1> to <6>, wherein the aqueous clear ink further includes a surfactant, and an amount of the surfactant is 2% by mass or less.

<8> The inkjet printing device according to <7>, wherein the surfactant is a fluorosurfactant.

<9> An inkjet printing method including:

ejecting an ink to a material to be printed to form a print layer; and heating the printed material to be printed, wherein the ink is an aqueous clear ink including a resin and water, the inkjet printing method has a low gloss printing mode that is a printing mode for imparting low gloss, and a high gloss printing mode that is a printing mode for imparting high gloss, and the heating is heating to satisfy the following formula $T_{matte}>T_{gloss}$, where $T_{matte}$ (degrees Celsius) is a temperature of a low gloss printing region of the material to be printed where the low gloss printing region is printed with the low gloss printing mode when the aqueous clear ink is deposited on the material to be printed, and $T_{gloss}$ (degrees Celsius) is a temperature of a high gloss printing region of the material to be printed where the high gloss printing region is printed with the high gloss printing mode when the aqueous clear ink is deposited on the material to be printed.

<10> The inkjet printing method according to <9>, wherein the heating satisfies the following formula $T_{matte}-T_{gloss}\geq 10$ degrees Celsius.

<11> An inkjet printing method including:

ejecting an ink to a material to be printed to form a print layer; and heating the printed material to be printed with a heating unit, wherein the ink is an aqueous clear ink including a resin and water, the inkjet printing method has a low gloss printing mode that is a printing mode for imparting low gloss, and a high gloss printing mode that is a printing mode for imparting high gloss, and the heating is heating to satisfy the following formula $HT_{matte}>HT_{gloss}$, where $HT_{matte}$ (degrees Celsius) is a temperature of the heating unit with the low gloss printing mode and $HT_{gloss}$ (degrees Celsius) is a temperature of the heating unit with the high gloss printing mode.

<12> The inkjet printing method according to any one of <9> or <11>, wherein the following formula $G_{matte}>G_{gloss}$ is satisfied, where $G_{matte}$ is glossiness of the material to be printed used for the low gloss printing mode, and $G_{gloss}$ is glossiness of the material to be printed used for the high gloss printing mode.

<13> The inkjet printing method according to any one of <9> to <12>, wherein an amount of the resin in the aqueous clear ink is 9% by mass or greater.

<14> The inkjet printing method according to any one of <9> to <13>, wherein the resin is a polyurethane resin.

<15> The inkjet printing method according to any one of <9> to <14>, wherein the aqueous clear ink further includes a surfactant, and an amount of the surfactant is 2% by mass or less.

<16> The inkjet printing method according to <15>, wherein the surfactant is a silicone surfactant, or an acetylene glycol surfactant, or both.

<17> A method for controlling glossiness of a printed image, the method including:

ejecting an ink to a material to be printed to form a print layer; and heating the printed material to be printed, wherein the ink is an aqueous clear ink including a resin and water, the method has a low gloss printing mode that is a printing mode for imparting low gloss, and a high gloss printing mode that is a printing mode for imparting high gloss, the heating is controlled to increase a heating temperature when printing is performed with the low gloss printing mode, and the heating is controlled to decrease the heating temperature when printing is performed with the high gloss printing mode.

<18> Printed matter including:

a material to be printed; and a print layer disposed on the material to be printed, wherein the print layer includes a clear ink layer including a resin, the printed matter includes a low gloss printed image printed with a low gloss printing mode and a high gloss printed image printed with a high gloss printing mode, a glossiness difference (Ga−Gb) between 60 degrees glossiness Ga of the high gloss printed image and 60 degrees glossiness Gb of the material to be printed used for the high gloss printing mode is 20 or greater, and a glossiness difference (Gc−Gd) between 60 degrees glossiness Gc of the low gloss printed image and 60 degrees glossiness Gd of the material to be printed used for the low gloss printing mode is −20 or less.

The inkjet printing device according to any one of <1> to <8>, the inkjet printing method according to any one of <9> to <16>, the method for controlling glossiness of a printed image according to <17>, and printed matter according to <18> can solve the above-described problems existing in the art and can achieve the object of the present disclosure.

REFERENCE SIGNS LIST

400: image forming apparatus
401: exterior of image forming apparatus
401*c*: cover of image forming apparatus
404: cartridge holder
410, 410*k*, 410*c*, 410*m*, 410*y*: main tank
411: ink container
413: ink discharging outlet
414: plastic housing unit
420: mechanical unit
434: discharging head
436: supply tube
L: ink storage container

The invention claimed is:

1. An inkjet printing device comprising:

at least one link storage container configured to store an ink;

an ejection head configured to eject the ink to form a print layer; and a heater configured to heat a material to be printed, wherein the ink is an aqueous clear ink including a resin and water, the inkjet printing device has a low gloss printing mode that is a printing mode for imparting low gloss, and a high gloss printing mode that is a printing mode for imparting high gloss, the heater is configured to heat to satisfy the following formula $T_{matte}>T_{gloss}$, where $T_{matte}$ (degrees Celsius) is a temperature of a low gloss printing region of the material to be printed where the low gloss printing region is printed with the low gloss printing mode when the aqueous clear ink is deposited on the material to be printed, and $T_{gloss}$ (degrees Celsius) is a temperature of a high gloss printing region of the material to be printed where the high gloss printing region is printed with the high gloss printing mode when the aqueous clear ink is deposited on the material to be printed, and a printing rate $D_{gloss}$ in the high gloss printing mode is greater than a printing rate $D_{matte}$ in the low gloss printing mode.

2. The inkjet printing device according to claim 1, wherein the heater is configured to heat to satisfy the following formula $T_{matte}-T_{gloss}\geq 10$ degrees Celsius.

3. The inkjet printing device according to claim 1, wherein the heater is configured to heat to satisfy the following formula $HT_{matte}>HT_{gloss}$, where $HT_{matte}$ (degrees Celsius) is a temperature of the heater with the low gloss printing mode and $HT_{gloss}$ (degrees Celsius) is a temperature of the heater with the high gloss printing mode.

4. The inkjet printing device according to claim 1, wherein the following formula $G_{matte}>G_{gloss}$ is satisfied, where $G_{matte}$ is glossiness of the material to be printed used for the low gloss printing mode, and $G_{gloss}$ is glossiness of the material to be printed used for the high gloss printing mode.

5. The inkjet printing device according to claim 1, wherein an amount of the resin in the aqueous clear ink is 8% by mass or greater.

6. The inkjet printing device according to claim 1, wherein the resin is a polyurethane resin.

7. The inkjet printing device according to claim 1, wherein the aqueous clear ink further includes a surfactant, and an amount of the surfactant is 2% by mass or less.

8. The inkjet printing device according to claim 7, wherein the surfactant is a fluorosurfactant.

9. The inkjet printing device according to claim 1, wherein:

the printing rate $D_{gloss}$ corresponds to a number of printed dots of clear ink/(vertical resolution×horizontal resolution)×100 in the high gloss printing mode, and the printing rate $D_{matte}$ corresponds to a number of printed dots of clear ink/(vertical resolution×horizontal resolution)×100 in the low gloss printing mode.

10. The inkjet printing device according to claim 1, wherein:

the printing rate $D_{gloss}$ corresponds to a percentage of ink weight of a single color relative to a pixel in the high gloss printing mode, and the printing rate $D_{matte}$ corresponds to a percentage of ink weight of a single color relative to a pixel in the low gloss printing mode.

11. An inkjet printing method comprising:

ejecting an ink to a material to be printed to form a print layer; and heating the printed material to be printed, wherein the ink is an aqueous clear ink including a resin and water, the inkjet printing method has a low gloss printing mode that is a printing mode for imparting low gloss, and a high gloss printing mode that is a printing mode for imparting high gloss, the heating is heating to satisfy the following formula $T_{matte}>T_{gloss}$, where $T_{matte}$ (degrees Celsius) is a temperature of a low gloss printing region of the material to be printed where the low gloss printing region is printed with the low gloss printing mode when the aqueous clear ink is deposited on the material to be printed, and $T_{gloss}$ (degrees Celsius) is a temperature of a high gloss printing region of the material to be printed where the high gloss printing region is printed with the high gloss printing mode when the aqueous clear ink is deposited on the material to be printed, and a printing rate $D_{gloss}$ in the high gloss printing mode is greater than a printing rate $D_{matte}$ in the low gloss printing mode.

12. The inkjet printing method according to claim 11, wherein the heating is heating to satisfy the following formula $HT_{matte}>HT_{gloss}$, where $HT_{matte}$ (degrees Celsius) is a temperature of the heating unit with the low gloss printing mode and $HT_{gloss}$ (degrees Celsius) is a temperature of the heating unit with the high gloss printing mode.

13. A method for controlling glossiness of a printed image, the method comprising:

ejecting an ink to a material to be printed to form a print layer; and heating the printed material to be printed, wherein the ink is an aqueous clear ink including a resin and water, the method has a low gloss printing mode that is a printing mode for imparting low gloss, and a high gloss printing mode that is a printing mode for imparting high gloss, the heating is controlled to increase a heating temperature when printing is performed with the low gloss printing mode, the heating is controlled to decrease the heating temperature when printing is performed with the high gloss printing mode, and a printing rate $D_{gloss}$ in the high gloss printing mode is greater than a printing rate $D_{matte}$ in the low gloss printing mode.

* * * * *